US008727159B2

(12) United States Patent
Wilkes et al.

(10) Patent No.: US 8,727,159 B2
(45) Date of Patent: May 20, 2014

(54) COLD BOX DESIGN PROVIDING SECONDARY CONTAINMENT

(75) Inventors: Michael A. Wilkes, Katy, TX (US); Jon M. Mock, Houston, TX (US)

(73) Assignee: ConocoPhillips Company, Houston, TX (US)

( * ) Notice: Subject to any disclaimer, the term of this patent is extended or adjusted under 35 U.S.C. 154(b) by 0 days.

(21) Appl. No.: 13/438,295

(22) Filed: Apr. 3, 2012

(65) Prior Publication Data

US 2012/0261415 A1 Oct. 18, 2012

Related U.S. Application Data

(60) Provisional application No. 61/474,479, filed on Apr. 12, 2011.

(51) Int. Cl.
*A62C 3/06* (2006.01)
*F17C 3/08* (2006.01)

(52) U.S. Cl.
CPC .... *A62C 3/06* (2013.01); *F17C 3/08* (2013.01)
USPC ..... 220/88.1; 220/560.1; 220/560.12; 220/23.89

(58) Field of Classification Search
CPC ..... F17C 3/08; F17C 3/085; A62C 3/06; A62C 3/065; A62C 3/00; B65D 90/22
USPC ..... 220/23.89, 23.87, 23.83, 560.1, 560.12, 220/560.04, 88.1, 623, 601
See application file for complete search history.

(56) References Cited

U.S. PATENT DOCUMENTS

| | | | | | |
|---|---|---|---|---|---|
| 1,424,604 | A | * | 8/1922 | Weber | 220/560.1 |
| 2,102,124 | A | * | 12/1937 | Lithgow | 220/562 |
| 2,559,876 | A | * | 7/1951 | Hoekstra | 422/145 |
| 3,312,076 | A | | 4/1967 | Clarke et al. | |
| 3,692,205 | A | | 9/1972 | Cowles et al. | |
| 4,971,214 | A | * | 11/1990 | Lillywhite et al. | 220/560.03 |
| 5,004,632 | A | | 4/1991 | McGarvey et al. | |
| 5,038,456 | A | * | 8/1991 | McGarvey | 29/460 |
| 5,202,098 | A | * | 4/1993 | Nichols | 422/300 |

(Continued)

FOREIGN PATENT DOCUMENTS

WO 2009147162 12/2009

OTHER PUBLICATIONS

PCT/US2012/032744 PCT International Search Report and Written Opinion dated Jun. 22, 2012.

*Primary Examiner* — Robert J Hicks
(74) *Attorney, Agent, or Firm* — ConocoPhillips Company

(57) ABSTRACT

The present invention relates to cryogenic fluids. In another aspect, the present invention relates to additional protection of an apparatus containing equipment capable of operating at cryogenic temperatures and containing cryogenic materials. In one embodiment of the present invention, an apparatus includes a primary enclosure defining an internal volume. The primary enclosure includes primary walls, a primary ceiling, a primary floor, and a vapor venting system. The primary enclosure is fabricated from a low temperature alloy. At least of a portion of the primary floor forms a slope to a hydrocarbon outlet. A perforated plate is located on top of the hydrocarbon outlet. The perforated plate is fabricated from a low temperature alloy. A fire retardant agent applied to the exterior surface of the primary enclosure.

41 Claims, 2 Drawing Sheets

(56) References Cited

U.S. PATENT DOCUMENTS

| | | | |
|---|---|---|---|
| 5,293,895 | A | 3/1994 | Grove et al. |
| 6,360,545 | B1 | 3/2002 | Goldstone et al. |
| 6,378,331 | B1 | 4/2002 | Vancauwenberghe et al. |
| 7,146,817 | B2 | 12/2006 | Baudat |
| 7,340,921 | B2 | 3/2008 | Cote et al. |
| 7,628,287 | B1 | 12/2009 | Arnold |
| 2009/0223974 | A1 | 9/2009 | Felius |
| 2011/0031861 | A1 | 2/2011 | Gentry et al. |

* cited by examiner

COLD BOX DESIGN PROVIDING SECONDARY CONTAINMENT

CROSS-REFERENCE TO RELATED APPLICATIONS

This application claims priority to and benefit of U.S. Provisional Patent Ser. No. 61/474,479 filed on Apr. 12, 2011, the entire disclosure of which is incorporated herein by reference.

FIELD OF THE INVENTION

The present invention relates to additional protection of an apparatus containing equipment capable of operating at cryogenic temperatures and containing cryogenic materials. In another aspect, the present invention relates to an apparatus for preventing heat leakage

BACKGROUND OF THE INVENTION

In many industrial applications, an apparatus that is designed to operate at cryogenic temperatures is located within an insulated container to minimize heat leakage from the ambient to the apparatus.

An example of an apparatus that has operational temperature requirements is a cryogenic distillation apparatus in which air is compressed, purified and then cooled to a temperature at or near its dew point for distillation in one or more distillation columns to separate lighter components such as nitrogen and argon from heavier components such as oxygen. The incoming air is cooled against product streams such as nitrogen and oxygen within a main heat exchanger.

Another example is a device for liquefying natural gas whereby gas from a high pressure pipeline is expanded, cooled and condensed to produce a liquefied natural gas (LNG) product.

In order to maintain the low temperatures required for such cryogenic operations, the equipment can be placed in a container known as a cold box. Such a container operates at a positive pressure, that is, the container is not sealed to the ambient environment. Bulk fill insulation, ordinarily in particulate form, is introduced into the container to provide insulation. Such bulk fill insulation, for example perlite, inhibits both convective and radiative heat transfer and constrains the heat transfer occurring through conduction.

A minimum insulation thickness is required to prevent excessive heat leakage. Typically, the container may be fabricated from a carbon steel material, which may not be suitable for exposure to cryogenic temperatures. However, a minimum insulation thickness is required to avoid brittle failure of the container walls and structural supports. As can be appreciated, the lower the thermal conductivity of the insulation, the smaller the minimum thickness of insulation, and the smaller the container due to less insulation.

While current containers exposed to cryogenic operations provide protection from external corrosion, additional protection from external fires would be desirable, particularly for cold boxes installed in a marine environment. Additionally, secondary leakage protection would be desirable for a location with limited space, which includes marine environments.

Currently, cold boxes containing cryogenic processing equipment provide adequate heat leakage properties and provide an inert environment to preserve the equipment. However, the current state of cold box equipment fails to provide any significant protection from external fires or secondary leakage protection, both of which are particularly valuable for situations where plot space is very limited, such as a marine environment.

SUMMARY OF THE INVENTION

In one embodiment of the present invention, an apparatus includes: (a) a primary enclosure defining an internal volume, wherein the primary enclosure includes primary walls, a primary ceiling, a primary floor, and a vapor venting system, wherein the primary enclosure is fabricated from a low temperature alloy, wherein at least a portion of the primary floor forms a slope, wherein the slope from a hydrocarbon outlet, wherein a perforated plate is located on top of the hydrocarbon outlet, wherein the perforated plate is fabricated from a low temperature alloy; and (b) a fire retardant agent applied to the exterior surface of the primary enclosure.

In another embodiment of the present invention, an apparatus includes: (a) a primary enclosure defining an internal volume, wherein the primary enclosure includes primary walls, a primary ceiling, a primary floor, and a vapor venting system, wherein the primary enclosure is fabricated from a low temperature alloy, wherein at least a portion of the primary floor forms a slope to a hydrocarbon outlet, wherein a perforated plate is located on top of the hydrocarbon outlet, wherein a perforated plate is fabricated from a low temperature alloy; (b) a secondary enclosure surrounding the primary enclosure defining a second internal volume, wherein the secondary enclosure includes secondary walls, a secondary ceiling and a secondary floor; and (c) a fire retardant agent applied to the exterior surface of the secondary enclosure.

In yet another embodiment of the present invention, an apparatus includes: (a) a primary enclosure defining an internal volume, wherein the primary enclosure includes primary walls, a primary ceiling, a primary floor, and a vapor venting system, wherein at least a portion of the primary floor forms a slope to a hydrocarbon drainage, wherein a perforated plate is located on top of the hydrocarbon drainage, wherein the perforated plate is fabricated from a low temperature alloy; (b) a secondary enclosure surrounding the primary enclosure defining a second internal volume, wherein the secondary enclosure includes secondary walls, a secondary ceiling and a secondary floor; and (c) a fire retardant agent applied to the exterior surface of the secondary enclosure.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

Reference will now be made in detail to embodiments of the invention, one or more examples of which are illustrated in the accompanying drawings. Each example is provided by way of explanation of the invention, not as a limitation of the invention. It will be apparent to those skilled in the art that various modifications and variation can be made in the present invention without departing from the scope or spirit of the invention. For instances, features illustrated or described as part of one embodiment can be used in another embodiment to yield a still further embodiment. Thus, it is intended that the present invention cover such modifications and variations that come within the scope of the appended claims and their equivalents.

Figure 1:
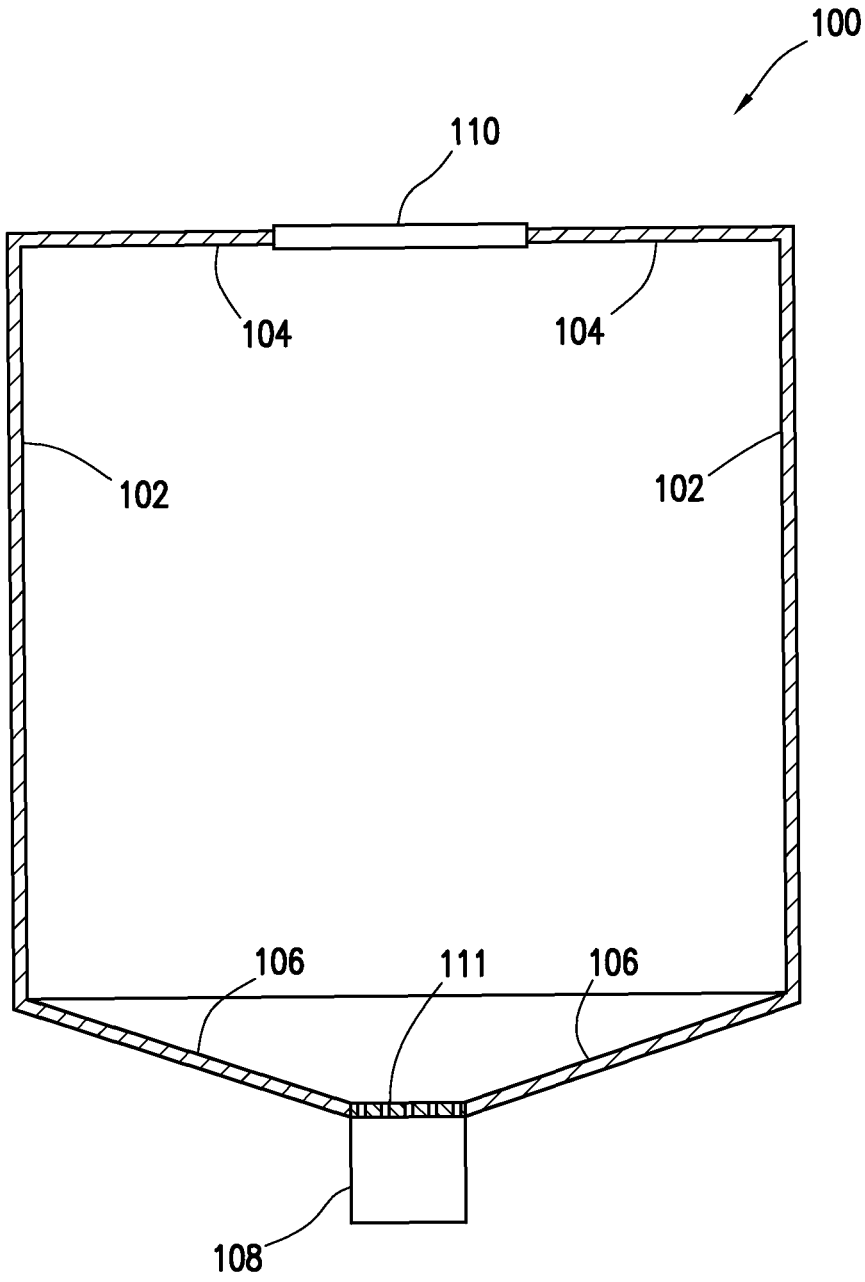
FIG. 1 is a schematic representation of an apparatus in accordance with an embodiment of the present invention.

FIG. 1 depicts a primary enclosure defining an internal volume. The primary enclosure can function as a thermal insulator capable of containing equipment operating at cryogenic temperatures. For instance, the primary enclosure can be a cold box. Additionally, the primary enclosure may contain several pieces of equipment, such as heat exchanger(s), separator(s) and/or column(s).

The primary enclosure 100 can be fabricated from various materials. In an embodiment, the primary enclosure is fabricated from a material designed to operate at cryogenic temperatures, i.e., a low temperature alloy. Low temperature alloys can include stainless steels and high nickel steels. Low temperature alloys provide the necessary protection against heat leakage and maintain integrity if exposed to cryogenic materials.

As depicted in FIG. 1, the primary enclosure 100 includes walls 102, a primary ceiling 104, a primary floor 106, and a vapor venting system 110. As previously mentioned, the internal volume of the primary enclosure 100 can include various pieces of equipment. For cryogenic operations, the equipment may be surrounded by bulk fill insulation. Examples of bulk fill insulation that may be used with the instant invention include perlite, silica aerogels, or any combination thereof. Alternatively, the enclosed volume in the box may be empty and the equipment and internal walls of the enclosure may be insulated to reduce the heat transfer to the pieces of equipment.

In FIG. 1, at least a portion of the primary floor 106 forms a slope to a hydrocarbon outlet 108 to encourage hydrocarbon drainage. This provides secondary containment for cryogenic liquids in the event that a piece of equipment, piping or instrumentation inside the cold box develops a leak. Cold boxes normally include an inert atmosphere so the draining of potential leaks along with the inert atmosphere provides an additional level of safety. A perforated plate 111 is located on top of the hydrocarbon outlet 108. The perforated plate 111 prevents the bulk fill insulation within the internal volume from exiting the primary enclosure 100. If the internal equipment is insulated and no bulk fill material is used, the perforated plate 111 is not required. In an embodiment, a screen covers the perforated plate 111. The area where the liquid may be collected has instrumentation to detect the presence of liquids and either automatically or through manual intervention, allows the collected liquids to be safely disposed. The perforated plate 111 may be fabricated from a low temperature alloy.

The vapor venting system 110 can be designed such that in the event of a leak, the system can safely vent the leaking vapors without exceeding the design pressure of the primary enclosure. Cryogenic vapor leaks would be collected and safely handled via a venting system on the side or roof of the primary enclosure. Instrumentation to detect the presence of leaking cryogenic vapors could be installed and allow either automatic or manual intervention to safely direct leaking materials to a safe location for disposal.

Structural support members, not shown in FIG. 1, can be constructed outside of the primary enclosure. The structural support members can be fabricated from a material that does not experience cold or brittle cracking, such as stainless steel, a material capable of functioning in a cryogenic environment with an insulating agent applied thereto, or a combination thereof. Insulation barriers, such as, micarta wood, can be used to separate the structural support members from those which are not designed to handle cryogenic temperatures.

A fire retardant agent may be applied to the exterior surface of the primary enclosure depicted in FIG. 1. The fire retardant protects the primary enclosure from external fires.

Figure 2:
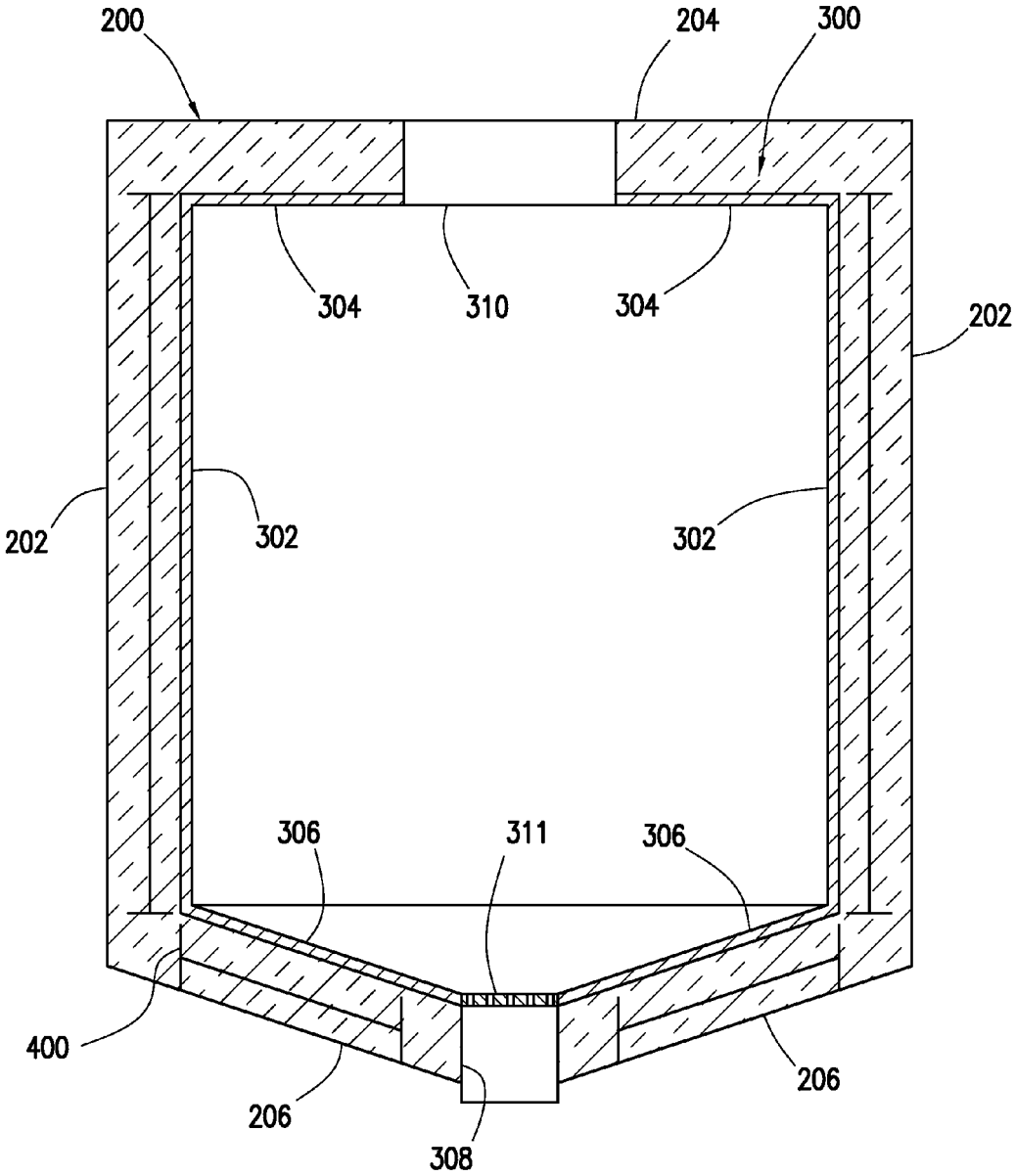
FIG. 2 is a schematic representation of an apparatus in accordance with an embodiment of the present invention.

FIG. 2 depicts a primary enclosure defining an internal volume surrounded by a secondary enclosure. The primary enclosure can function as a container of the thermal insulation capable of containing equipment operating at cryogenic temperatures. For instance, the primary enclosure can be a cold box. Additionally, the primary enclosure may contain several pieces of equipment, such as heat exchanger(s), separator(s) and/or column(s).

If the primary enclosure is fabricated from a low temperature alloy, then a secondary enclosure is optional. However, if the primary enclosure is fabricated from a material merely capable of functioning as the container of the insulation material in a cryogenic environment and not designed to operate at cryogenic temperatures, then insulation of that material is necessary along with a secondary enclosure.

Referring to FIG. 2, the primary enclosure 300 includes primary walls 302, a primary ceiling 304, a primary floor 306, and a vapor venting system 310. At least a portion of the primary floor 306 forms a slope to a hydrocarbon outlet 308 to encourage hydrocarbon drainage. A perforated plate 110 is located on top of the of the hydrocarbon outlet 308. The perforated plate prevents the bulk fill insulation within the internal volume from exiting the primary enclosure. A screen may cover the perforated plate. The perforated plate can be fabricated from a low temperature alloy.

The secondary enclosure, formed around the primary enclosure, 200 includes secondary walls 202, a secondary ceiling 204 and a secondary floor 206. The secondary enclosure provides additional protection against heat leakage. At least a portion of the secondary floor 206 forms a slope.

The primary enclosure can be fabricated from a low temperature alloy, a material capable of functioning in a cryogenic environment with an insulating agent applied thereto, or combinations thereof. For example, the walls and ceiling of the primary enclosure can be fabricated from a material capable of functioning in a cryogenic environment with an insulating agent applied thereto. The secondary floor can be fabricated from a low temperature alloy.

Carbon steel, for example, is a material capable of functioning in a cryogenic environment. However, carbon steel can experience cold brittle fracture if exposed to cryogenic fluids. Thus, an insulating agent must be applied to carbon steel surface exposed to a cryogenic environment.

The secondary enclosure can be fabricated from a low temperature alloy, a material capable of functioning in a cryogenic environment, or combinations thereof.

The vapor venting system 310 can be designed such that in the event of a leak, the system can safely vent the leaking vapors without exceeding the design pressure of the primary enclosure. Cryogenic vapor leaks would be collected and safely handled via a venting system on the side or roof of the primary enclosure. Instrumentation to detect the presence of leaking cryogenic vapors may be installed to allow either automatic or manual intervention to safely direct leaking materials to a safe location for disposal.

Structural support members 400 can be constructed between the primary and secondary enclosures. The volume between structural support members between the primary and secondary enclosures can be purged with dry air. The structural support members can be fabricated from a material that does not experience cold or brittle cracking, such as stainless steel, a material capable of functioning in a cryogenic environment with an insulating agent, or a combination thereof. Insulation barriers, such as, micarta wood, can be used to separate the structural support members from those which are not resistant to cryogenic materials.

A fire retardant agent may be applied to the exterior surface of the primary enclosure depicted in FIG. 2. The fire retardant protects the primary enclosure from external fires.

The advantages of the modified cold boxes are that they offer an additional layer of safety protection that safely disposes of potentially flammable materials in the event of a leak inside a cold box. Additionally, if leaking materials outside the cold box cause a fire to the modified cold boxes protect the equipment inside the cold box from an external fire.

In closing, it should be noted that the discussion of any reference is not an admission that it is prior art to the present invention, especially any reference that may have a publication date after the priority date of this application. At the same time, each and every claim below is hereby incorporated into this detailed description or specification as additional embodiments of the present invention.

Although the systems and processes described herein have been described in detail, it should be understood that various changes, substitutions, and alterations can be made without departing from the spirit and scope of the invention as defined by the following claims. Those skilled in the art may be able to study the preferred embodiments and identify other ways to practice the invention that are not exactly as described herein. It is the intent of the inventors that variations and equivalents of the invention are within the scope of the claims while the description, abstract and drawings are not to be used to limit the scope of the invention. The invention is specifically intended to be as broad as the claims below and their equivalents.

The invention claimed is:

1. An apparatus comprising:

a. a primary enclosure defining an internal volume, wherein the primary enclosure comprises primary walls, a primary ceiling, a primary floor, and a vapor venting system, wherein the primary enclosure is fabricated from a low temperature alloy, wherein at least a portion of the primary floor forms a slope to a hydrocarbon outlet, wherein a perforated plate is located on top of the hydrocarbon outlet, wherein the perforated plate is fabricated from a low temperature alloy; and b. a fire retardant agent applied to the exterior surface of the primary enclosure.

2. The apparatus according to claim 1, wherein the low temperature alloy is stainless steel or a high nickel steel.

3. The apparatus according to claim 1, wherein the internal volume of the primary enclosure comprises bulk fill insulation.

4. The apparatus according to claim 3, wherein the bulk fill insulation is perlite, silica aerogel, or any combination thereof.

5. The apparatus according to claim 3, wherein the perforated plate prevents the bulk fill insulation from exiting the apparatus.

6. The apparatus according to claim 1, wherein a screen is on top of the perforated plate.

7. The apparatus according to claim 1, wherein the primary enclosure is a cold box.

8. The apparatus according to claim 1, wherein the apparatus is utilized in offshore facilities.

9. The apparatus according to claim 1, wherein the apparatus is utilized in onshore facilities.

10. An apparatus comprising:

a. a primary enclosure defining an internal volume, wherein the primary enclosure comprises primary walls, a primary ceiling, a primary floor, and a vapor venting system, wherein the primary enclosure is fabricated from a low temperature alloy, wherein at least a portion of the primary floor forms a slope to a hydrocarbon outlet, wherein a perforated plate is located on top of the hydrocarbon outlet, wherein the perforated plate is fabricated from a low temperature alloy;

b. a secondary enclosure surrounding the primary enclosure defining a second internal volume, wherein the secondary enclosure comprises secondary walls, a secondary ceiling and a secondary floor; and c. a fire retardant agent applied to the exterior surface of the secondary enclosure.

11. The apparatus according to claim 10, wherein the low temperature alloy is stainless steel or a high nickel steel.

12. The apparatus according to claim 10, wherein the secondary enclosure is fabricated from a low temperature alloy, a material capable of functioning in a cryogenic environment, or combinations thereof.

13. The apparatus according to claim 12, wherein the material capable of functioning in a cryogenic environment is carbon steel.

14. The apparatus according to claim 12, wherein the low temperature alloy is stainless steel or a high nickel steel.

15. The apparatus according to claim 10, wherein the internal volume of the primary enclosure comprises a bulk fill insulation.

16. The apparatus according to claim 15, wherein the bulk fill insulation is perlite, silica aerogel, or any combination thereof.

17. The apparatus according to claim 16, wherein the perforated plate prevents the perlite from exiting the apparatus.

18. The apparatus according to claim 10, wherein the fire retardant agent is applied to the exterior surface of the primary enclosure.

19. The apparatus according to claim 10, wherein the second internal volume comprises structural support members.

20. The apparatus according to claim 10, wherein the primary enclosure is a cold box.

21. The apparatus according to claim 10 wherein the apparatus is utilized in offshore facilities.

22. The apparatus according to claim 10, wherein the apparatus is utilized in onshore facilities.

23. An apparatus comprising:

a. a primary enclosure defining an internal volume, wherein the primary enclosure comprises primary walls, a primary ceiling, a primary floor, and a vapor venting system, wherein at least a portion of the primary floor forms a slope to a hydrocarbon drainage, wherein a perforated plate is located on top of the hydrocarbon drainage, wherein the perforated plate is fabricated from a low temperature alloy;

b. a secondary enclosure surrounding the primary enclosure defining a second internal volume, wherein the secondary enclosure comprises secondary walls, a secondary ceiling and a secondary floor; and c. a fire retardant agent applied to the exterior surface of the secondary enclosure.

24. The apparatus according to claim 23, wherein the primary walls are fabricated from a low temperature alloy, a material capable of operating in a cryogenic environment with an insulating agent applied to the primary walls, or a combination thereof.

25. The apparatus according to claim 24, wherein the low temperature alloy is stainless steel or a high nickel steel.

26. The apparatus according to claim 24, wherein the material capable of functioning in a cryogenic environment is carbon steel.

27. The apparatus according to claim 23, wherein the primary ceiling is fabricated from a low temperature alloy, a material capable of operating in a cryogenic environment with an insulating agent applied the primary ceiling, or a combination thereof.

28. The apparatus according to claim 27, wherein the low temperature alloy is stainless steel or a high nickel steel.

29. The apparatus according to claim 24, wherein the material capable of functioning in a cryogenic environment is carbon steel.

30. The apparatus according to claim 23, wherein the secondary walls are fabricated from a low temperature alloy, a material capable of operating in a cryogenic environment with an insulating agent applied the secondary walls, or a combination thereof.

31. The apparatus according to claim 30, wherein the low temperature alloy is stainless steel or a high nickel steel.

32. The apparatus according to claim 30, wherein the material capable of functioning in a cryogenic environment is carbon steel.

33. The apparatus according to claim 23, wherein the secondary ceiling is fabricated from a low temperature alloy; a material capable of operating in a cryogenic environment with an insulating agent applied the secondary ceiling, or a combination thereof.

34. The apparatus according to claim 33, wherein the low temperature alloy is stainless steel or a high nickel steel.

35. The apparatus according to claim 33, wherein the material capable of functioning in a cryogenic environment is carbon steel.

36. The apparatus according to claim 23, wherein the internal volume of the primary enclosure comprises perlite.

37. The apparatus according to claim 36, wherein the perforated plate prevents the perlite from exiting the apparatus.

38. The apparatus according to claim 23, wherein the second internal volume comprises structural support members.

39. The apparatus according to claim 23, wherein the primary enclosure is a cold box.

40. The apparatus according to claim 23, wherein the apparatus is utilized in offshore facilities.

41. The apparatus according to claim 23, wherein the apparatus is utilized in onshore facilities.

* * * * *